US005957319A

United States Patent [19]

Shane da Costa

[11] Patent Number: 5,957,319

[45] Date of Patent: Sep. 28, 1999

[54] GARBAGE CONTAINER COVER AND LINER PROTECTOR

[76] Inventor: Cardinall Mowbrey Shane da Costa, 10500 SW 108th Ave. #B-112, Miami, Fla. 33176

[21] Appl. No.: 09/124,732

[22] Filed: Jul. 30, 1998

[51] Int. Cl.[6] ..... B65D 43/00

[52] U.S. Cl. ..... 220/495.06; 220/252; 220/908

[58] Field of Search ..... 220/495.06, 495.05, 220/252, 254, 908, 908.1

[56] References Cited

U.S. PATENT DOCUMENTS

| | | | |
|---|---|---|---|
| 63,665 | 4/1867 | Stafford | 220/252 X |
| 329,026 | 10/1885 | De La Vergne, Jr. | 220/252 X |
| 1,333,051 | 3/1920 | Young | 220/252 |
| 2,080,786 | 5/1937 | Robles | 220/252 |
| 2,250,729 | 7/1941 | Smith et al. | 220/252 |
| 4,955,497 | 9/1990 | Winden et al. | 220/495.06 X |
| 5,170,904 | 12/1992 | Neuhaus | 220/908 X |
| 5,295,607 | 3/1994 | Chang | 220/908 X |
| 5,881,896 | 3/1999 | Presnell et al. | 220/252 |

*Primary Examiner*—Steven Pollard

[57] ABSTRACT

A new garbage container cover and liner protector for preventing a trash liner from falling into the container. The inventive device includes a cylindrical container having an open upper end, a closed lower end and a cylindrical side wall therebetween. The cylindrical container is dimensioned for holding a garbage liner therein. A lid portion is secured to the open upper end of the cylindrical container. The lid portion has a dome shaped configuration. The lid portion includes at least one spherical section and a spherical opening therethrough. At least one spherical cover portion is pivotally coupled within the lid portion. The cover portion is slidably disposed within the spherical opening. The cover portion slides under the spherical section of the lid portion in an open orientation. A liner engaging portion is disposed within the spherical opening. The liner engaging portion includes a pair of strap members. One of the strap members is secured to a trailing edge of the cover portion. A second strap member is secured to an upper edge of the open upper end of the container. The strap members secure an open upper end of a garbage liner with respect to the cover portion and the container whereby sliding the cover portion into the open orientation will expose the open upper end of the garbage liner for receiving garbage therein. Each of the strap members have free ends thereof secured to a latch for tightening of the straps for engaging the garbage liner.

3 Claims, 3 Drawing Sheets

FIG. 1
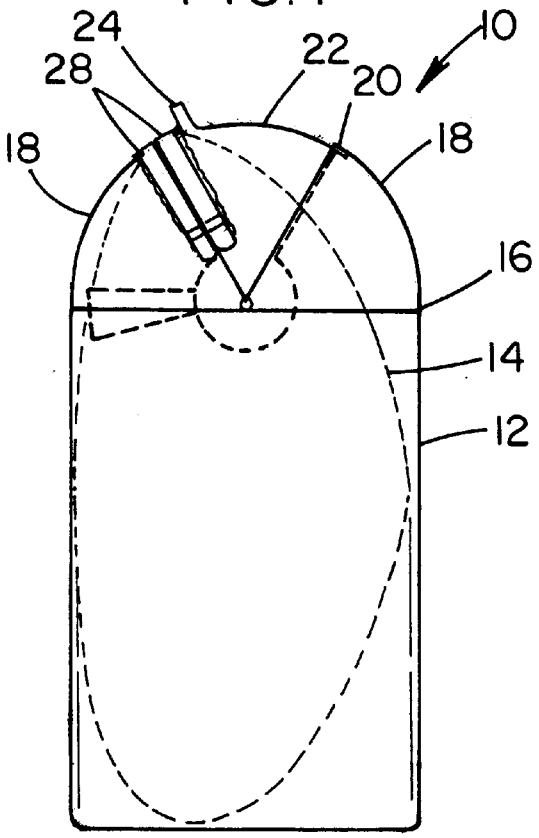
FIG. 2
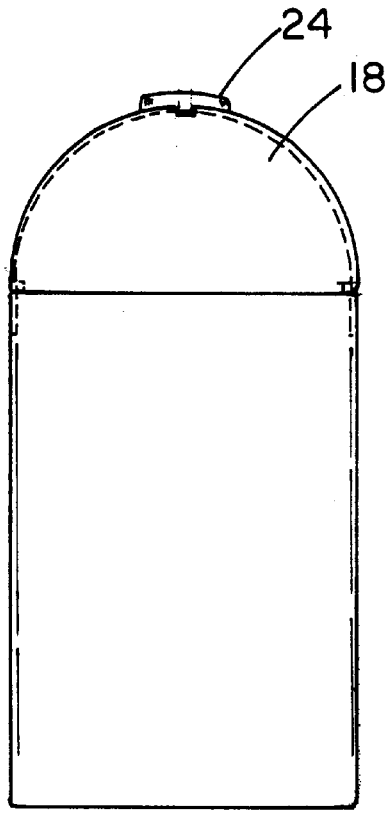
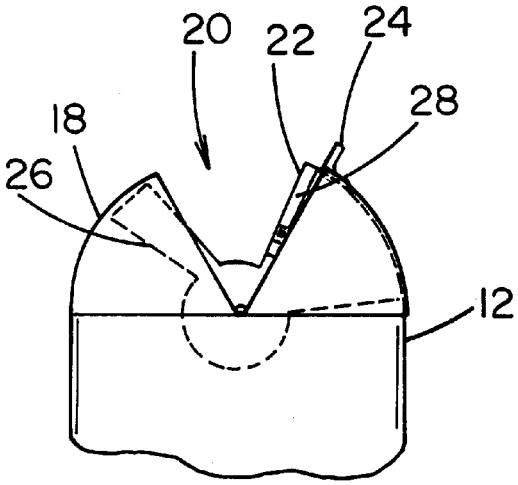
FIG. 3
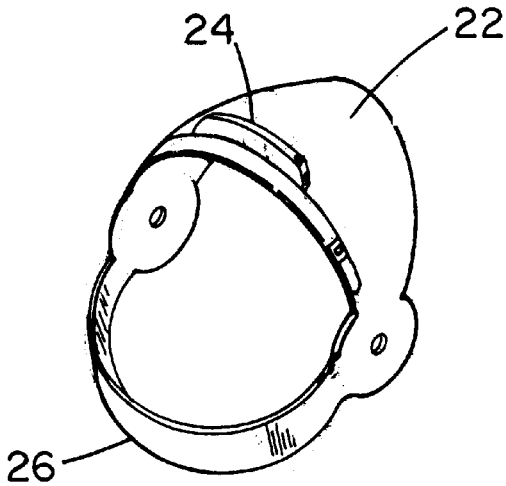
FIG. 4

FIG.5
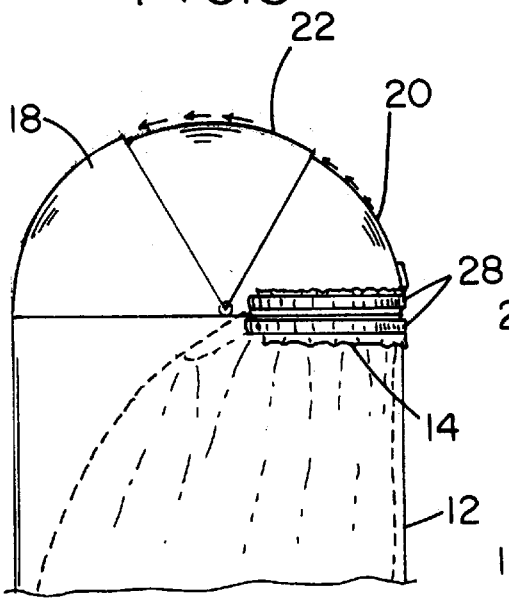
FIG.6
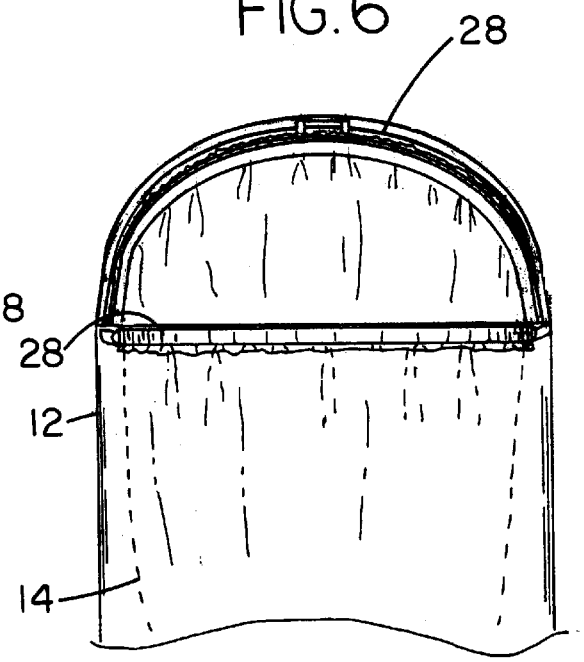
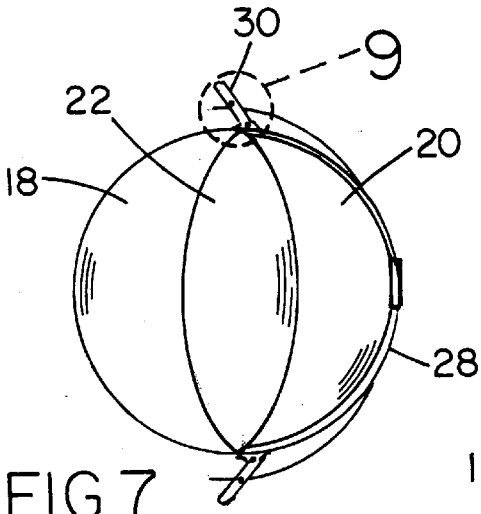
FIG.7
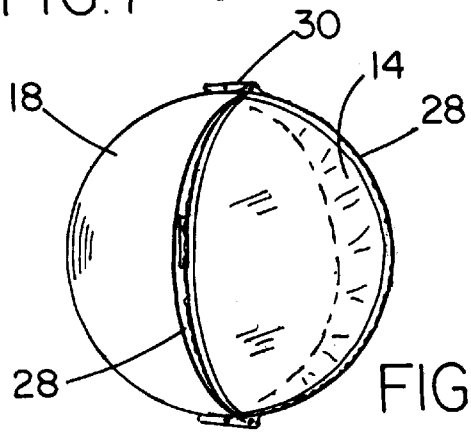
FIG.8
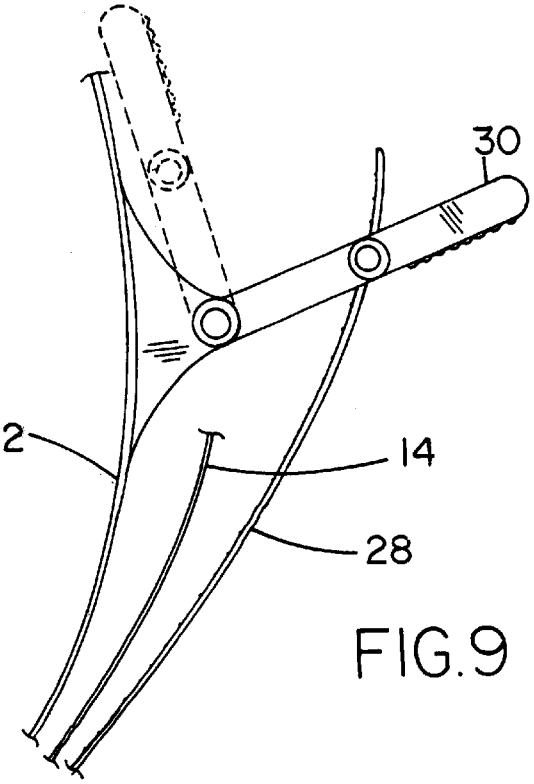
FIG.9

GARBAGE CONTAINER COVER AND LINER PROTECTOR

BACKGROUND OF THE INVENTION

1. Field of the Invention

The present invention relates to trash container covers and more particularly pertains to a new garbage container cover and liner protector for keeping an inside and an outside of the cover clean by eliminating contact between trash and the cover.

2. Description of the Prior Art

The use of trash container covers is known in the prior art. More specifically, trash container covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art trash container covers include U.S. Pat. No. 5,170,904 to Neuhaus; U.S. Pat. No. 4,351,539 to Rodolakis; U.S. Pat. No. Des. 335,565 to Juergens; U.S. Pat. No. Des. 312,523 to Delmerico et al.; U.S. Pat. No. Des. 268,059 to Kracke; and U.S. Pat. No. 5,050,762 to Giorgi.

While these devices fulfill their respective, particular objectives and requirements, the aforementioned patents do not disclose a new garbage container cover and liner protector. The inventive device includes a cylindrical container having an open upper end, a closed lower end and a cylindrical side wall therebetween. The cylindrical container is dimensioned for holding a garbage liner therein. A lid portion is secured to the open upper end of the cylindrical container. The lid portion has a dome shaped configuration. The lid portion includes at least one spherical section and a spherical opening therethrough. At least one spherical cover portion is pivotally coupled within the lid portion. The cover portion is slidably disposed within the spherical opening. The cover portion slides under the spherical section of the lid portion in an open orientation. A liner engaging portion is disposed within the spherical opening. The liner engaging portion includes a pair of strap members. One of the strap members is secured to a trailing edge of the cover portion. A second strap member is secured to an upper edge of the open upper end of the container. The strap members secure an open upper end of a garbage liner with respect to the cover portion and the container whereby sliding the cover portion into the open orientation will expose the open upper end of the garbage liner for receiving garbage therein. Each of the strap members have free ends thereof secured to a latch for tightening of the straps for engaging the garbage liner.

In these respects, the garbage container cover and liner protector according to the present invention substantially departs from the conventional concepts and designs of the prior art, and in so doing provides an apparatus primarily developed for the purpose of preventing a trash liner from failing into the container.

SUMMARY OF THE INVENTION

In view of the foregoing disadvantages inherent in the known types of trash container covers now present in the prior art, the present invention provides a new garbage container cover and liner protector construction wherein the same can be utilized for preventing a trash liner from falling into the container.

The general purpose of the present invention, which will be described subsequently in greater detail, is to provide a new garbage container cover and liner protector apparatus and method which has many of the advantages of the trash container covers mentioned heretofore and many novel features that result in a new garbage container cover and liner protector which is not anticipated, rendered obvious, suggested, or even implied by any of the prior art trash container covers, either alone or in any combination thereof.

To attain this, the present invention generally comprises a cylindrical container having an open upper end, a closed lower end and a cylindrical side wall therebetween. The cylindrical container is dimensioned for holding a garbage liner therein. A lid portion is secured to the open upper end of the cylindrical container. The lid portion has a dome shaped configuration. The lid portion includes a pair of opposed spherical sections with a spherical opening therebetween. The spherical opening is centrally disposed over the open upper end of the cylindrical container. A spherical cover portion is pivotally coupled within the lid portion. The cover portion is slidably disposed within the spherical opening. The cover portion has a handle extending upwardly therefrom. The cover portion slides under a first of the spherical sections of the lid portion in an open orientation. The cover portion has a U-shaped weight portion secured to an interior portion thereof. The weight portion biases the cover portion into a closed orientation. A liner engaging portion is disposed within the spherical opening. The liner engaging portion includes a pair of strap members. One of the strap members is secured to a trailing edge of the cover portion. A second strap member is secured to a leading edge of a second of the spherical sections of the lid portion. The strap members secure an open upper end of a garbage liner with respect to the cover portion and the second spherical section whereby sliding the cover portion into the open orientation will expose the open upper end of the garbage liner for receiving garbage therein. Each of the strap members have free ends thereof secured to a latch for tightening of the straps for engaging the garbage liner.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new garbage container cover and liner protector apparatus and method which has many of the advantages of the trash container covers mentioned heretofore and many novel features that result in a new garbage container cover and liner protector which is not anticipated, rendered obvious, suggested, or even implied by any of the prior art trash container covers, either alone or in any combination thereof.

It is another object of the present invention to provide a new garbage container cover and liner protector which may be easily and efficiently manufactured and marketed.

It is a further object of the present invention to provide a new garbage container cover and liner protector which is of a durable and reliable construction.

An even further object of the present invention is to provide a new garbage container cover and liner protector which is susceptible of a low cost of manufacture with regard to both materials and labor, and which accordingly is then susceptible of low prices of sale to the consuming public, thereby making such garbage container cover and liner protector economically available to the buying public.

Still yet another object of the present invention is to provide a new garbage container cover and liner protector which provides in the apparatuses and methods of the prior art some of the advantages thereof, while simultaneously overcoming some of the disadvantages normally associated therewith.

Still yet another object of the present invention is to provide new garbage container cover and liner protector which keeps an inside and outside of the cover clean to the touch by way of operation.

Still another object of the present invention is to provide a new garbage container cover and liner protector for preventing a trash liner from falling into the container.

Yet another object of the present invention is to provide a new garbage container cover and liner protector which includes a cylindrical container having an open upper end, a closed lower end and a cylindrical side wall therebetween. The cylindrical container is dimensioned for holding a garbage liner therein. A lid portion is secured to the open upper end of the cylindrical container. The lid portion has a dome shaped configuration. The lid portion includes at least one spherical section and a spherical opening therethrough. At least one spherical cover portion is pivotally coupled within the lid portion. The cover portion is slidably disposed within the spherical opening. The cover portion slides under the spherical section of the lid portion in an open orientation. A liner engaging portion is disposed within the spherical opening. The liner engaging portion includes a pair of strap members. One of the strap members is secured to a trailing edge of the cover portion. A second strap member is secured to an upper edge of the open upper end of the container. The strap members secure an open upper end of a garbage liner with respect to the cover portion and the container whereby sliding the cover portion into the open orientation will expose the open upper end of the garbage liner for receiving garbage therein. Each of the strap members have free ends thereof secured to a latch for tightening of the straps for engaging the garbage liner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side view of a new garbage container cover and liner protector according to the present invention.

FIG. 2 is a rear view of the present invention.

FIG. 3 is a side view of the present invention shown in an open orientation.

FIG. 4 is an isometric view of the movable spherical segment of the present invention.

FIG. 5 is a side view of the present invention shown in a closed orientation.

FIG. 6 is a front view of the present invention shown in an open orientation.

FIG. 7 is a top plan view of the present invention shown in a closed orientation.

FIG. 8 is a top plan view of the present invention shown in an open orientation.

FIG. 9 is a plan view of the latch and strap of the present invention.

DESCRIPTION OF THE PREFERRED EMBODIMENT

Figure 10:
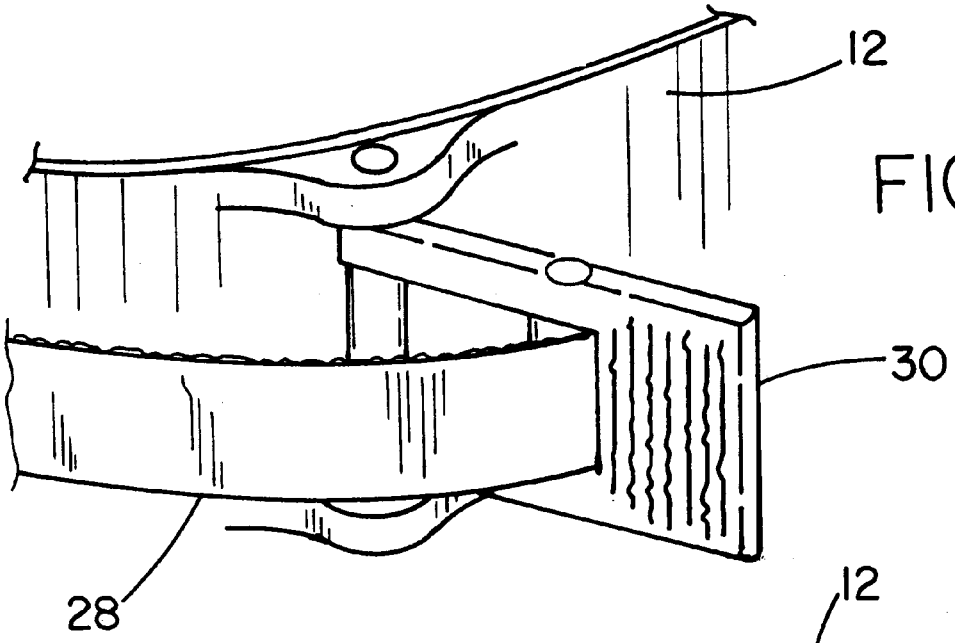
FIG. 10 is an isometric view of the latch in an open orientation.
Figure 11:
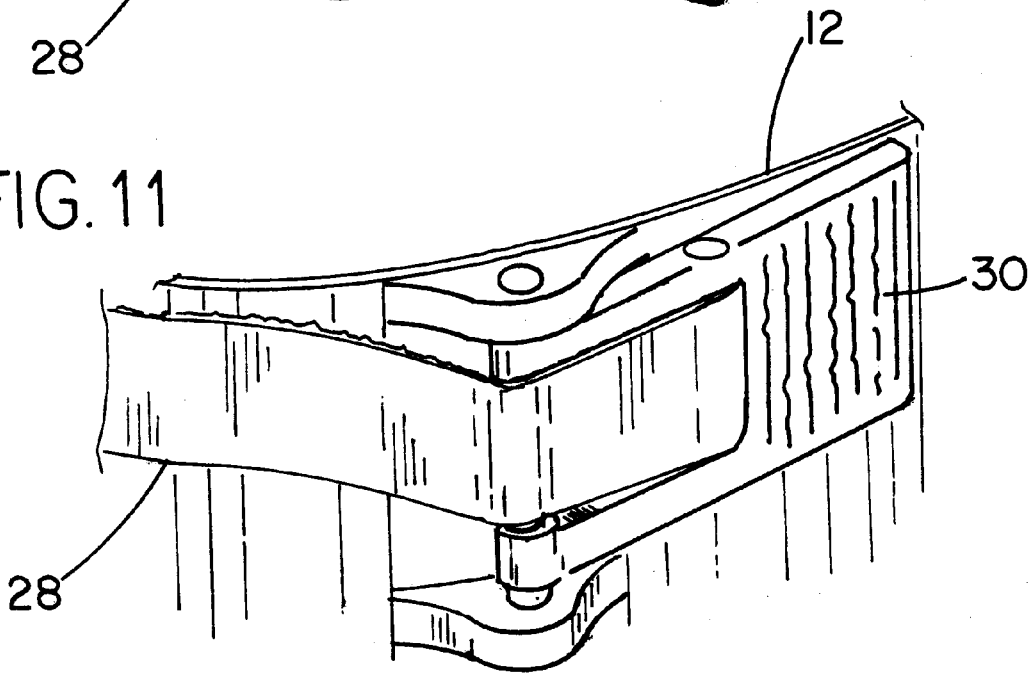
FIG. 11 is an isometric view of the latch in a closed orientation.

With reference now to the drawings, and in particular to FIGS. 1 through 11 thereof, a new garbage container cover and liner protector embodying the principles and concepts of the present invention and generally designated by the reference numeral 10 will be described.

As best illustrated in FIGS. 1 through 11, the garbage container cover and liner protector 10 comprises a cylindrical container 12 having an open upper end, a closed lower end and a cylindrical side wall therebetween. The cylindrical container 12 is dimensioned for holding a garbage liner 14 therein.

A lid portion 16 is secured to the open upper end of the cylindrical container 12. The lid portion 16 has a dome shaped configuration. The lid portion 16 includes a pair of opposed spherical sections 18 with a spherical opening 20 therebetween. The spherical opening 20 is centrally disposed over the open upper end of the cylindrical container 12.

A spherical cover portion 22 is pivotally coupled within the lid portion 16. The cover portion 22 is slidably disposed within the spherical opening 20. The cover portion 22 has a handle 24 extending upwardly therefrom. The cover portion 22 slides under a first of the spherical sections 18 of the lid portion 16 in an open orientation. The cover portion 22 has a U-shaped weight portion 26 secured to an interior portion thereof. The weight portion 26 biases the cover portion 22 into a closed orientation.

A liner engaging portion is disposed within the spherical opening. The liner engaging portion includes a pair of strap members 28. One of the strap members 28 is secured to a trailing edge of the cover portion 22. A second strap member 28 is secured to a leading edge of a second of the spherical sections 18 of the lid portion 16. The strap members 28 secure an open upper end of a garbage liner 14 with respect to the cover portion 22 and the second spherical section 18 whereby sliding the cover portion 22 into the open orientation will expose the open upper end of the garbage liner 14 for receiving garbage therein. Each of the strap members 28 have free ends thereof secured to a latch 30 for tightening of the straps 28 for engaging the garbage liner 14.

An alternate embodiment of the present invention is illustrated in FIGS. 5–11. In this embodiment, the garbage liner 14 is secured by the pair of straps 28 between the trailing edge of the cover portion 22 and an upper edge of the open upper end of the container 12. Additionally, an additional cover member 22 is included in place of one of the spherical sections 18.

In use, the present invention would secure a plastic garbage liner 14 in place so it would not collapse inside the container 12 when heavily laden with garbage and other debris. The present invention would attach a rim of the liner to the cover; this keeps the inside and the outside of the cover clean, because of the elimination of contact between trash and the cover.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new garbage container cover and liner protector for preventing a trash liner from falling into the container comprising, in combination:

a cylindrical container having an open upper end, a closed lower end and a cylindrical side wall therebetween, the cylindrical container dimensioned for holding a garbage liner therein;

a lid portion secured to the open upper end of the cylindrical container, the lid portion having a dome shaped configuration, the lid portion including a pair of opposed spherical sections with a spherical opening therebetween, the spherical opening being centrally disposed over the open upper end of the cylindrical container;

a spherical cover portion pivotally coupled within the lid portion, the cover portion being slidably disposed within the spherical opening, the cover portion having a handle extending upwardly therefrom, the cover portion sliding under a first of the spherical sections of the lid portion in an open orientation, the cover portion having a U-shaped weight portion secured to an interior portion thereof, the weight portion biasing the cover portion into a closed orientation;

a liner engaging portion disposed within the spherical opening, the liner engaging portion including a pair of strap members, one of the strap members secured to a trailing edge of the cover portion, a second strap member secured to a leading edge of a second of the spherical sections of the lid portion, the strap members securing an open upper end of a garbage liner with respect to the cover portion and the second spherical section whereby sliding the cover portion into the open orientation will expose the open upper end of the garbage liner for receiving garbage therein, each of the strap members having free ends thereof secured to a latch for tightening of the straps for engaging the garbage liner.

2. A new garbage container cover and liner protector for preventing a trash liner from falling into the container comprising, in combination:

a cylindrical container having an open upper end, a closed lower end and a cylindrical side wall therebetween, the cylindrical container dimensioned for holding a garbage liner therein;

a lid portion secured to the open upper end of the cylindrical container, the lid portion having a dome shaped configuration, the lid portion including at least one spherical section and a spherical opening therethrough;

at least one spherical cover portion pivotally coupled within the lid portion, the cover portion being slidably disposed within the spherical opening, the cover portion sliding under the spherical section of the lid portion in an open orientation;

a liner engaging portion disposed within the spherical opening, the liner engaging portion including a pair of strap members, one of the strap members secured to a trailing edge of the cover portion, a second strap member secured to an upper edge of the open upper end of the container, the strap members securing an open upper end of a garbage liner with respect to the cover portion and the container whereby sliding the cover portion into the open orientation will expose the open upper end of the garbage liner for receiving garbage therein, each of the strap members having free ends thereof secured to a latch for tightening of the straps for engaging the garbage liner.

3. The garbage container cover and liner protector as set forth in claim 2 wherein a pair of cover portions are provided for sliding under a single spherical section.

* * * * *

UNITED STATES PATENT AND TRADEMARK OFFICE

CERTIFICATE OF CORRECTION

PATENT NO. : 5,957,319

DATED : September 28, 1999

INVENTOR(S) : Cardinall Mowbrey Shane DaCosta

It is certified that error appears in the above-identified patent and that said Letters Patent is hereby corrected as shown below:

In the heading, line 2, "Shane da Costa" should read -- DaCosta--.

In the heading to the printed specification, line 4, "Cardinall Mowbrey Shane da Costa" should read --Cardinall Mowbrey Shane DaCosta--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*